US009706822B2

(12) United States Patent
Tseng et al.

(10) Patent No.: US 9,706,822 B2
(45) Date of Patent: Jul. 18, 2017

(54) FOLDING SUITCASE

(71) Applicant: TWINKLE LEATHERWARE CO., LTD., Kwai Chung (HK)

(72) Inventors: Tzu-Wei Tseng, Kwai Chung (HK); Hung-Sheng Lin, Kwai Chung (HK); Cheng-Cheng Chen, Kwai Chung (HK); Wai-Ming Wong, Kwai Chung (HK)

(73) Assignee: TWINKLE LEATHERWARE CO., LTD., Kwai Chung (HK)

( * ) Notice: Subject to any disclaimer, the term of this patent is extended or adjusted under 35 U.S.C. 154(b) by 352 days.

(21) Appl. No.: 14/296,993

(22) Filed: Jun. 5, 2014

(65) Prior Publication Data

US 2015/0296940 A1 Oct. 22, 2015

(30) Foreign Application Priority Data

Apr. 18, 2014 (TW) ..... 103206864 U

(51) Int. Cl.

| | |
|---|---|
| ***A45C 7/00*** | (2006.01) |
| ***A45C 5/03*** | (2006.01) |
| ***A45C 13/00*** | (2006.01) |
| ***A45C 5/14*** | (2006.01) |
| ***A45C 13/02*** | (2006.01) |

(52) U.S. Cl.

CPC ..... *A45C 5/03* (2013.01); *A45C 5/14* (2013.01); *A45C 7/0036* (2013.01); *A45C 13/005* (2013.01); *A45C 13/02* (2013.01)

(58) Field of Classification Search

CPC ... A45C 7/0022; A45C 7/0036; A45C 7/0077; A45C 7/0063

USPC ..... 190/103, 104, 107, 106; 220/6, 9.2, 9.3; 383/33, 104

See application file for complete search history.

(56) References Cited

U.S. PATENT DOCUMENTS

| | | | | |
|---|---|---|---|---|
| 736,871 A * | 8/1903 | O'Brien | A45C 7/0036 | 190/104 |
| 1,060,824 A * | 5/1913 | Cunningham | A45C 7/0031 | 190/104 |
| 1,182,692 A * | 5/1916 | Lawler | A45C 7/0022 | 190/103 |
| 3,730,308 A * | 5/1973 | Pelavin | A45C 3/001 | 190/115 |

(Continued)

FOREIGN PATENT DOCUMENTS

| | | | |
|---|---|---|---|
| GB | 1358662 | * | 7/1974 |
| TW | M471788 U | | 2/2014 |

*Primary Examiner* — Sue A Weaver

(74) *Attorney, Agent, or Firm* — Maschoff Brennan

(57) ABSTRACT

A folding suitcase includes a back case component, a front lid component, a circumferential surface component, and a restoring component. Two opposite sides of the circumferential surface component are connected with the back case component and the front lid component, respectively, so as to form an accommodating space selectively. The circumferential surface component has multiple sidewall parts and multiple bending parts connected with the multiple sidewall parts. The multiple bending parts are bendable to lead the multiple sidewall parts to be capable of being folded oppositely or being erected on the back case component. The restoring component is located on at least one bending part. The restoring component is elastic for erecting the multiple sidewall parts.

9 Claims, 10 Drawing Sheets

(56) References Cited

U.S. PATENT DOCUMENTS

| | | | | | |
|---|---|---|---|---|---|
| 4,610,334 | A * | 9/1986 | Pelavin | A45C 3/001 | 190/122 |
| 4,787,488 | A * | 11/1988 | Campanini | A45C 7/0031 | 190/104 |
| 7,175,010 | B1 * | 2/2007 | Miner | A45C 7/0036 | 190/107 |
| 8,820,498 | B2 * | 9/2014 | Benshetrit | A45C 7/0018 | 190/103 |
| 2005/0034948 | A1 * | 2/2005 | Tiramani | A45C 7/0036 | 190/107 |
| 2005/0056643 | A1 * | 3/2005 | Hagan | A45C 7/0077 | 220/9.3 |
| 2006/0169690 | A1 * | 8/2006 | Rothschild | A45C 7/0036 | 220/7 |
| 2010/0282556 | A1 * | 11/2010 | Tseng | A45C 7/0077 | 190/107 |
| 2011/0048882 | A1 * | 3/2011 | Chiang | A45C 5/03 | 190/107 |
| 2011/0174583 | A1 * | 7/2011 | Yoneno | A45C 5/14 | 190/103 |
| 2012/0285781 | A1 * | 11/2012 | Bettua | A45C 5/02 | 190/18 A |

* cited by examiner

FOLDING SUITCASE

CROSS-REFERENCE TO RELATED APPLICATIONS

This non-provisional application claims priority under 35 U.S.C. §119(a) on Patent Application No(s). 103206864 filed in Taiwan, R.O.C. on Apr. 18, 2014, the entire contents of which are hereby incorporated by reference.

BACKGROUND

Technical Field

The disclosure relates to a suitcase. More particularly, the disclosure relates to a folding suitcase.

Related Art

When traveling, a user needs a suitcase for accommodating necessities and souvenirs. The suitcase can be a carry-on suitcase, a medium suitcase, or a large suitcase according to its size. The medium suitcase or the large suitcase has a larger accommodating space for accommodating more necessities and souvenirs. However, the suitcase with a larger accommodating space cannot be easily stored at home when not traveling. Thus, a folding suitcase (as shown in Patent Application No. M471788 filed in Taiwan, R.O.C.) was developed to meet the needs of a larger accommodating space and being easily stored at the same time. In other words, the folding suitcase can be expanded for accommodating necessities and souvenirs. Additionally, the folding suitcase can also be folded to decrease its size, so that the folding suitcase can be stored easily.

In the prior art, the folding suitcase can meet the needs of a larger accommodating space and be easier to store. However, the folding suitcase needs to be unfolded manually, which is inconvenient for the user. In other words, the folding suitcase cannot be automatically unfolded as expected and the folding suitcase always stays in a folding state or a half-folding state. Accordingly, the user needs to restore the folding suitcase manually or bend the bending parts of the folding suitcase, to unfold the folding suitcase. Thus, it is necessary to develop a folding suitcase which can be restored automatically.

SUMMARY

The disclosure provides a folding suitcase, which comprises a back case component, a front lid component, a circumferential surface component, and a restoring component. Two opposite sides of the circumferential surface component are connected with the back case component and the front lid component, respectively, so as to form an accommodating space selectively. The circumferential surface component has a plurality of sidewall parts and a plurality of bending parts connected with the plurality of sidewall parts. The plurality of bending parts are bendable to lead the plurality of sidewall parts to be capable of being folded oppositely or being erected on the back case component. The restoring component is located on at least one bending part. The restoring component is elastic for erecting the plurality of sidewall parts.

BRIEF DESCRIPTION OF THE DRAWINGS

The disclosure will become more fully understood from the detailed description given herein-below and the accompanying drawings which are given by way of illustration only and thus are not limitative of the disclosure, and wherein.

DETAILED DESCRIPTION

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawings.

Figure 1:
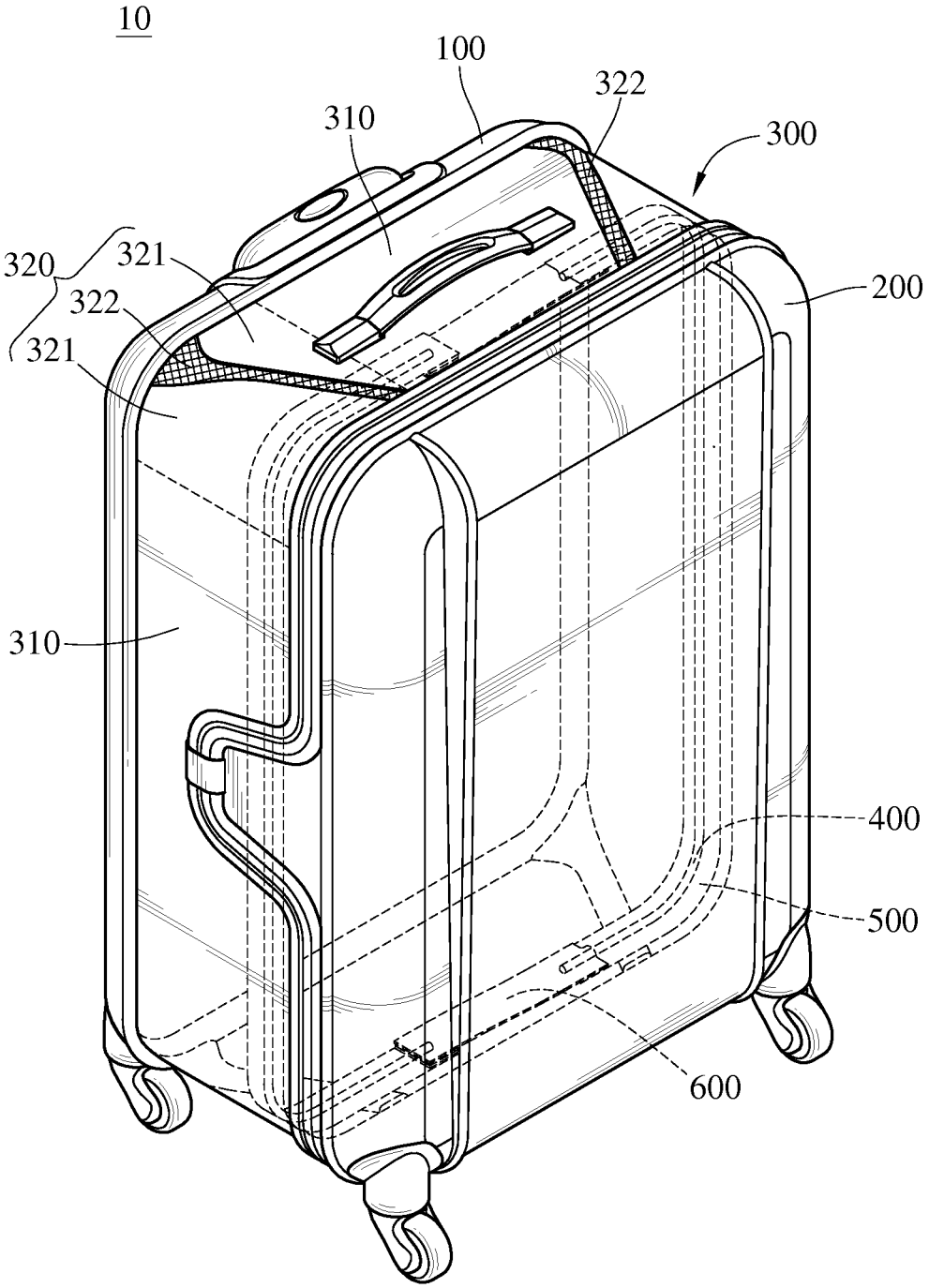
FIG. 1 is a perspective view of a folding suitcase according to a first embodiment of the disclosure.
Figure 2:
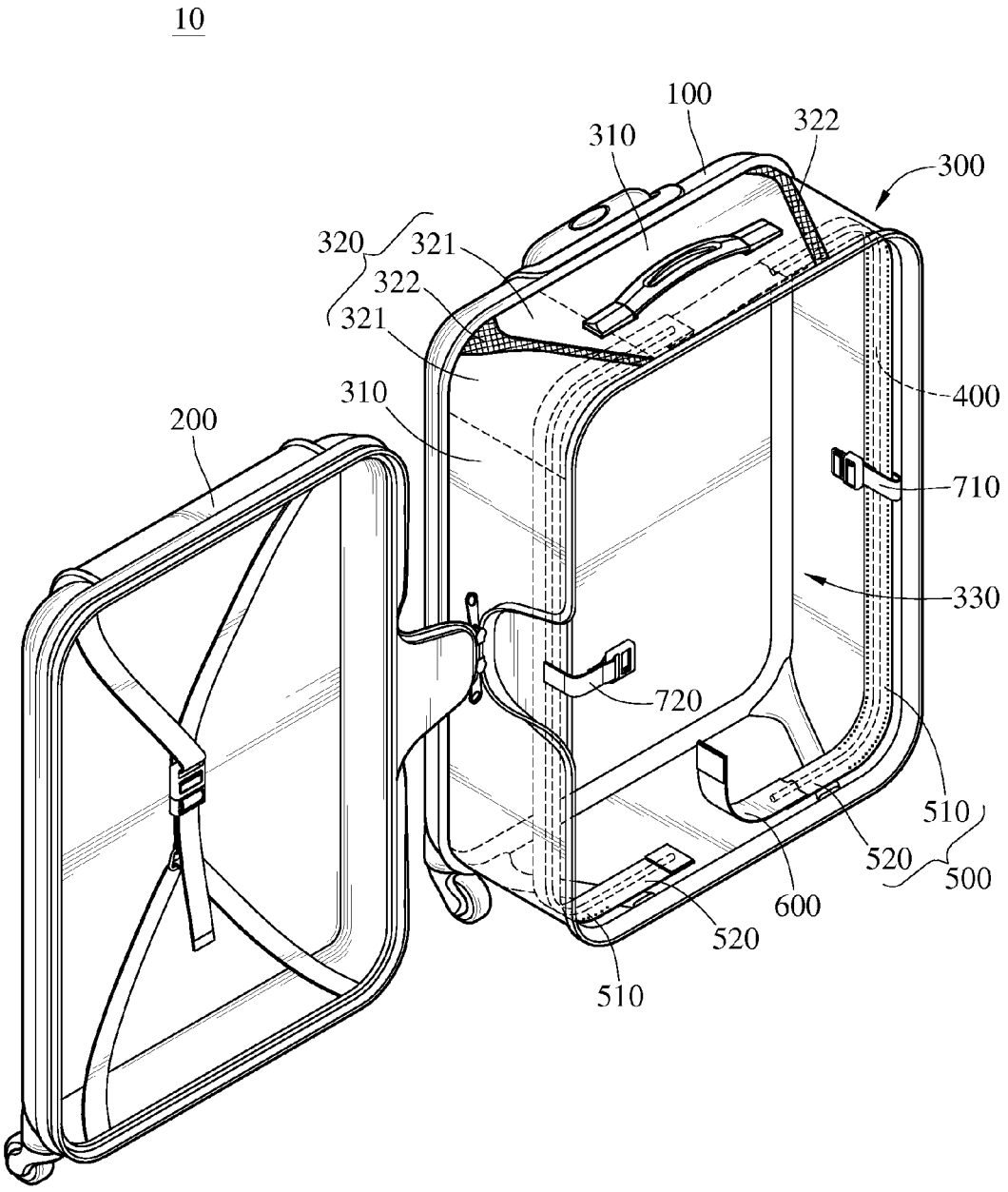
FIG. 2 is a perspective view of the opened folding suitcase in FIG. 1.
Figure 3:
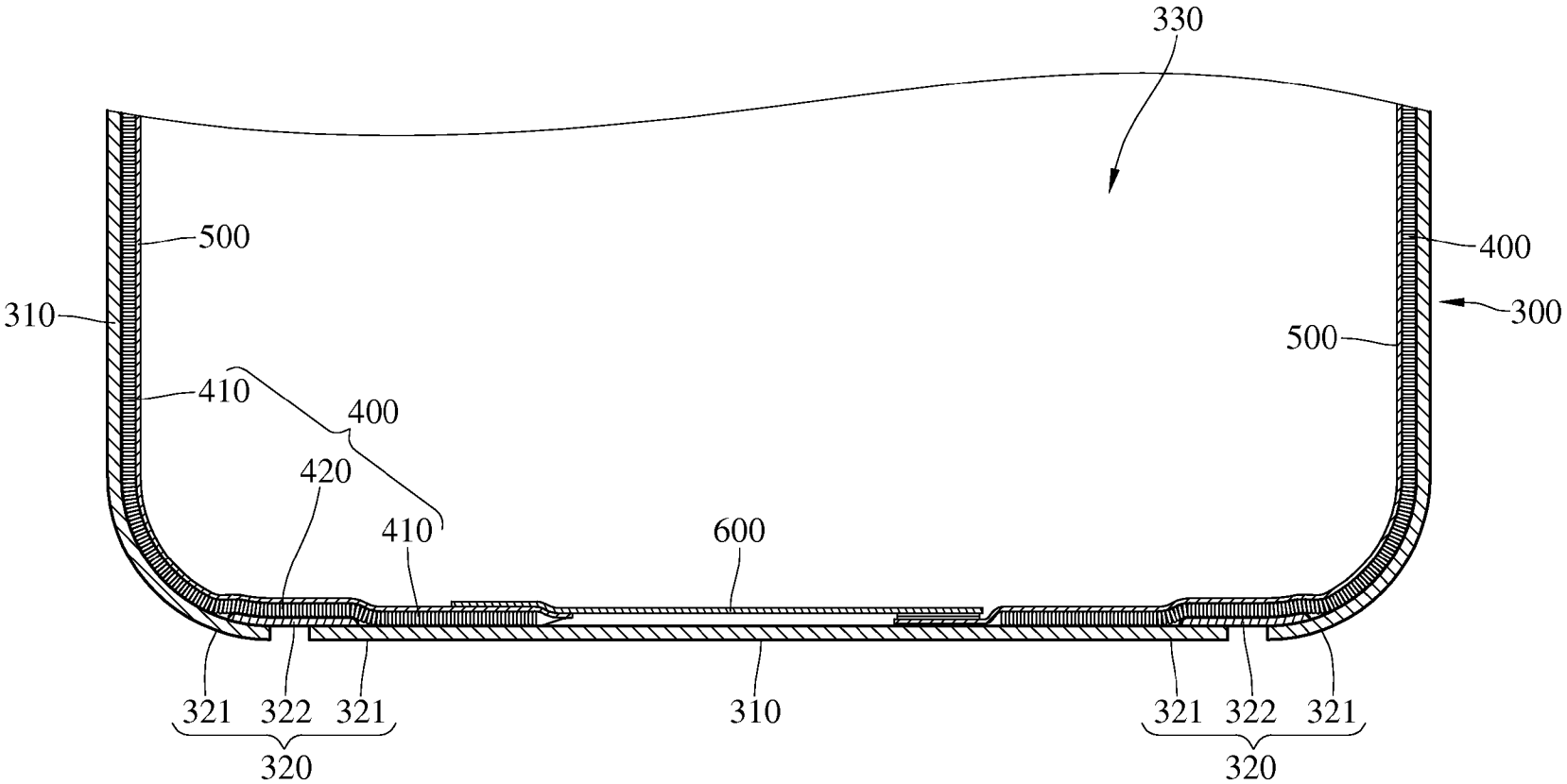
FIG. 3 is a partially sectional view of a circumferential surface component in FIG. 2.
Figure 4:
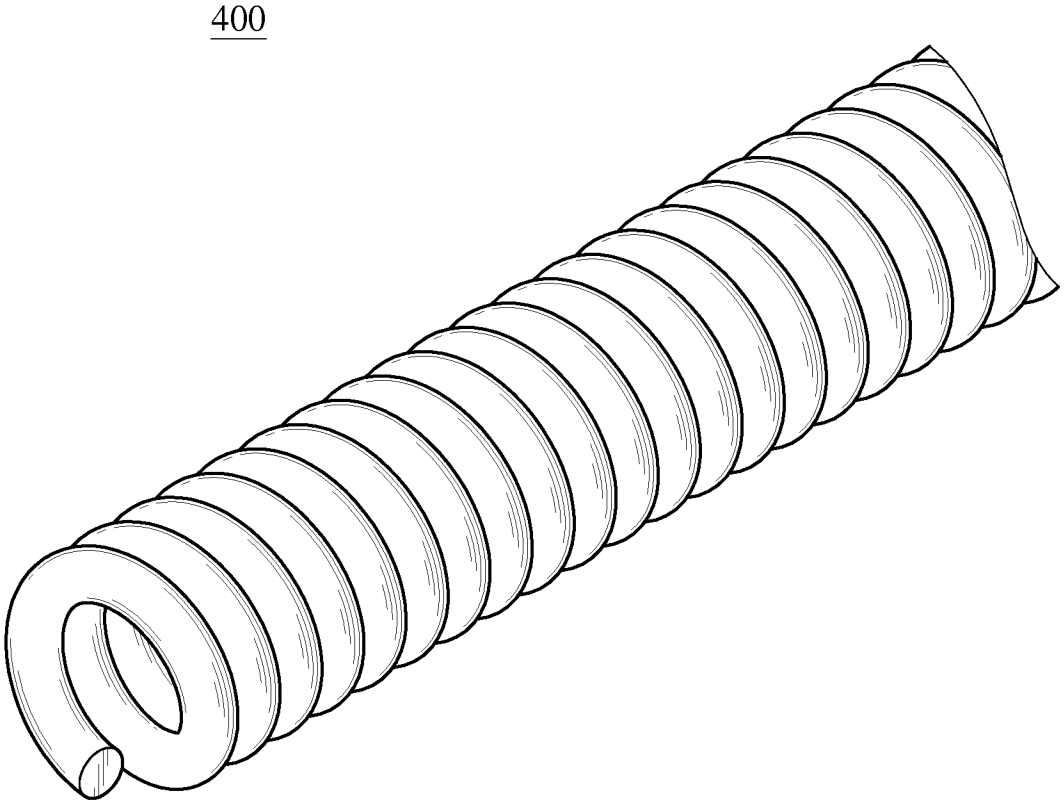
FIG. 4 is a partially perspective view of a restoring component in FIG. 2.

Please refer to FIGS. 1 to 4. FIG. 1 is a perspective view of a folding suitcase according to a first embodiment of the disclosure. FIG. 2 is a perspective view of the opened folding suitcase in FIG. 1. FIG. 3 is a partial sectional view of a circumferential surface component in FIG. 2. FIG. 4 is a partial perspective view of a restoring component in FIG. 2. In an embodiment, the folding suitcase 10 comprises a back case component 100, a front lid component 200, a circumferential surface component 300, two restoring components 400, two bendable fixing components 500, and two elastic components 600.

Two opposite sides of the circumferential surface component 300 are connected with the back case component 100 and the front lid component 200, respectively, to form an accommodating space 330 which is closed or opened. In this embodiment, one side of the circumferential surface component 300 and the back case component 100 are stitched together, and the other side of the circumferential surface component 300 and the front lid component 200 are joined together by a zipper. When the zipper is zipped up (as shown in FIG. 1), the front lid component 200 is adapted to close the accommodating space 330. When the zipper is unzipped (as shown in FIG. 2), the front lid component 200 can be opened so that the accommodating space 330 is exposed accordingly. Additionally, the disclosure is not limited to the above-mentioned configuration. In another embodiment, the two opposite sides of the circumferential surface component 300 can be joined to the back case component 100 and the front lid component 200 by two zippers, respectively.

Furthermore, the back case component 100 and the front lid component 200 are, but not limited to, made of plastic plates made from polyethylene (PE), polypropylene (PP), polycarbonate (PC), ethylene-vinyl acetate (EVA), polyvinyl chloride (PVC) or acrylonitrile butadiene styrene (ABS) resin. In another embodiment, the back case component 100 and the front lid component 200 are made of cloth.

In this embodiment, the circumferential surface component 300 is made from composite materials, such as relatively harder materials (cloth, PE, PVC, PP, PC, EVA or ABS resin) and relatively softer materials (cane cloth, styrene-butadiene rubber (SBR), jersey (150 Denier), polyurethane (PU), rubber, thermoplastic polyurethane (TPU), sandwich mesh fabric, neoprene, polyester fabric, thermoplastic rubbers (TPR), webbing, or leather). In this embodiment, the circumferential surface component 300 has a plurality of sidewall parts 310 and a plurality of bending parts 320 connected with the plurality of sidewall parts 310. The plurality of bending parts 320 are bendable to lead the plurality of sidewall parts 310 to be capable of being folded oppositely or being erected on the back case component 100. The plurality of sidewall parts 310 being folded (namely, stacked) oppositely means that inner wall surfaces of the sidewall parts 310 are folded on the back case component 100. The plurality of sidewall parts 310 being erected oppositely means that the sidewall parts 310 are perpendicular or almost perpendicular to the back case component 100. Additionally, parts of the circumferential surface component 300 adapted to generate fold lines or contortions are defined as the bending parts 320 during a folding process. Oppositely, the other parts of the circumferential surface component 300 are defined as the sidewall parts 310.

Each sidewall part 310 is, but not limited to, made of a cloth layer (1682 Denier) with PU bottom, an EVA layer, and a PP plate layer. Each bending part 320 has two link-up sections 321 and a bending section 322. Two opposite ends of the bending section 322 are connected with the two link-up sections 321, respectively. The two link-up sections 321 are connected to the two sidewall parts 310, respectively. The materials of the link-up sections 321 are the same as the materials of the sidewall parts 310. In other words, the link-up sections 321 are, but not limited to, made of a cloth (1682 Denier) layer with PU bottom, an EVA layer, and a PP plate layer. The bending section 322 is, but not limited to, made of a cane cloth layer, a SBR layer, and a jersey (150 Denier) layer. The ability of the bending contortion of the bending section 322 is better than the link-up sections' 321. The cane cloth layer can be made from SBR. The ability of the bending contortion of the cane cloth layer, the SBR layer and the jersey (150 Denier) layer are better than the cloth (1682 Denier) layer's with PU bottom, the EVA layer's and the PP plate layer's. Additionally, the cane cloth layer, the SBR layer and the jersey (150 Denier) layer are bendable. Accordingly, the plurality of sidewall parts 310 are led to be folded on the back case component 100 when the bending parts 320 are bent.

As shown in FIG. 2, the two restoring components 400 are located on an inner side of the circumferential surface component 300 by two bendable fixing components 500. The inner side of the circumferential surface component 300 where the two restoring components 400 are located is away from the back case component 100. The bendable fixing components 500 may be cloth, elastic ribbon or nylon. Each bendable fixing component 500 has a fixing section 510 and a suspension section 520 connected with the fixing section 510. The two fixing sections 510 are located on the circumferential surface component 300. Two ends of the elastic component 600 are connected with the two suspension sections 520 different from each other, respectively. The elastic component 600 may be an elastic ribbon. The fixing section 510 can be stitched on the circumferential surface component 300. The suspension sections 520 are not fixed on the circumferential surface component 300. The two suspension sections 520 connected to each other by the elastic component 600 are adapted to provide a spare space for contortions of the restoring component 400. Additionally, an elastic force may be provided to the two suspension sections 520 by the elastic component 600 for restoring to its original position.

To assemble the elastic component 600 more conveniently, one end of the elastic component 600 is stitched on one of the suspension sections 520, and the other end of the elastic component 600 is fastened to another suspension section 520 by a Velcro®.

In this embodiment, the restoring components 400 are, but not limited to, located on an inner side of the circumferential surface component 300. In another embodiment, the restoring components 400 are located on an outer side of the circumferential surface component 300.

In this embodiment, the quantity of the restoring component 400 is, but not limited to, two. Additionally, the two restoring components 400 surround the accommodating space 330, but the disclosure is not limited thereto. In another embodiment, the quantity of the restoring component 400 is one, and the only one restoring component 400 surrounds the accommodating space 330 singly.

In this embodiment, each restoring component 400 crosses at least one bending part 320. The restoring component 400 (such as a helical spring or an elastic strip) is elastic for erecting the plurality of sidewall parts 310. For example, the restoring component 400 may be adapted to erect the plurality of sidewall parts 310 at an upright position, where the plurality of sidewall parts 310 stand vertically on the back case component 100, from a non-upright position (where the plurality of sidewall parts 310 are not at the upright position). Accordingly, the elastic potential energy can be generated by bending the helical spring in a lateral direction or tensioning the elastic strip, to drive the sidewall parts 310 to be erected which were not upright. The lateral direction is perpendicular to the axial extension line of the restoring component 400.

Furthermore, the restoring component 400 is a helical spring, and the shape of the restoring component 400 is cylindrical shape. The two restoring components 400 have two connection sections 410 and an elastic contortion section 420, respectively. The two connection sections 410 are connected with two opposite sides of the elastic contortion section 420, respectively. The two connection sections 410 are located on the two sidewall parts 310 different from each other, respectively. Additionally, the elastic contortion section 420 crosses at least one bending part 320.

In this embodiment, the shape of the restoring component 400 is cylindrical shape. Accordingly, the same elastic potential energies can be generated in each direction by the lateral bending of the restoring component 400, so that the restoring component 400 can be restored steadily.

The restoring principle of the restoring component 400 is described as follows. The contortion section 420 has a feature of elastic contortion. The elastic contortion means that the contortion section 420 can be contorted by a force. When the force is removed, the contortion section 420 can be restored if the elastic contortion is still in the elastic limit of the contortion section 420. In this embodiment, the sidewall parts 310 are driven to be erected by the elastic contortion of the elastic contortion section 420.

Figure 5B:
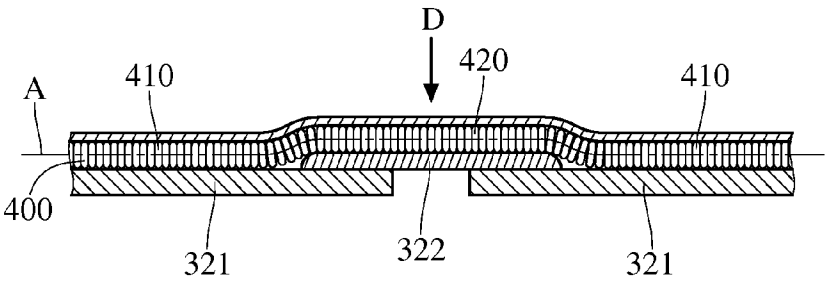
FIG. 5B is a sectional view of the restoration of the circumferential surface component in FIG. 3.
Figure 5A:
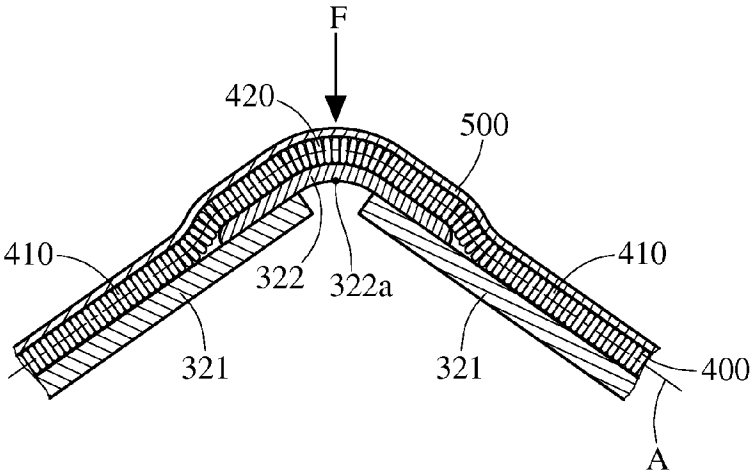
FIG. 5A is a sectional view of the circumferential surface component contorted by an external force in FIG. 3.

Please refer to FIG. 5A and FIG. 5B. FIG. 5A is a sectional view of the circumferential surface component contorted by an external force in FIG. 3. FIG. 5B is a sectional view of the restoration of the circumferential surface component in FIG. 3. As shown in FIG. 5A, the bending part 320 are bent relative to the sidewall part 310 when the circumferential surface component 300 is applied by the external force. Then, the bending section 322 of the sidewall part 310 is adapted to form a fold line 322*a*. Accordingly, the bending part 320 presses the elastic contortion section 420 of the restoring component 400, to drive the elastic contortion section 420 to bend in the lateral direction, so that a restoring force F is generated from an elastic potential energy stored by the elastic contortion section 420. Moreover, the extension line of each restoring component 400 and the fold lines 321*a* and 322*a* are intersected with each other.

As shown in FIG. 5B, when the external force is removed, the restoring force F generated by the elastic contortion section 420 drives the bending part 320 to restore to its original position along a direction indicated by an arrow D.

Figure 6:
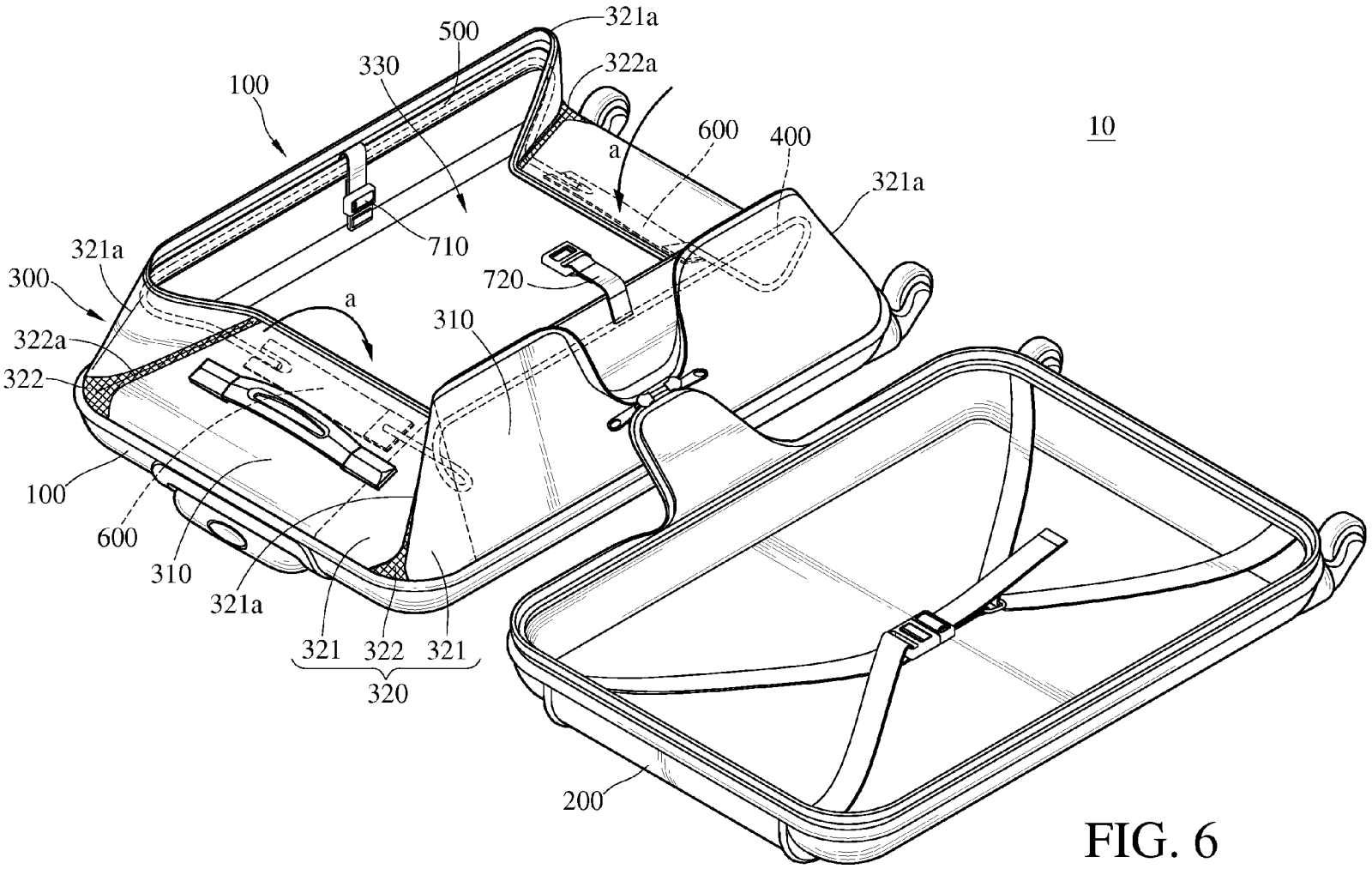
FIG. 6 and FIG. 7 are schematic views of the circumferential surface component during a folding process in FIG. 2.
Figure 7:
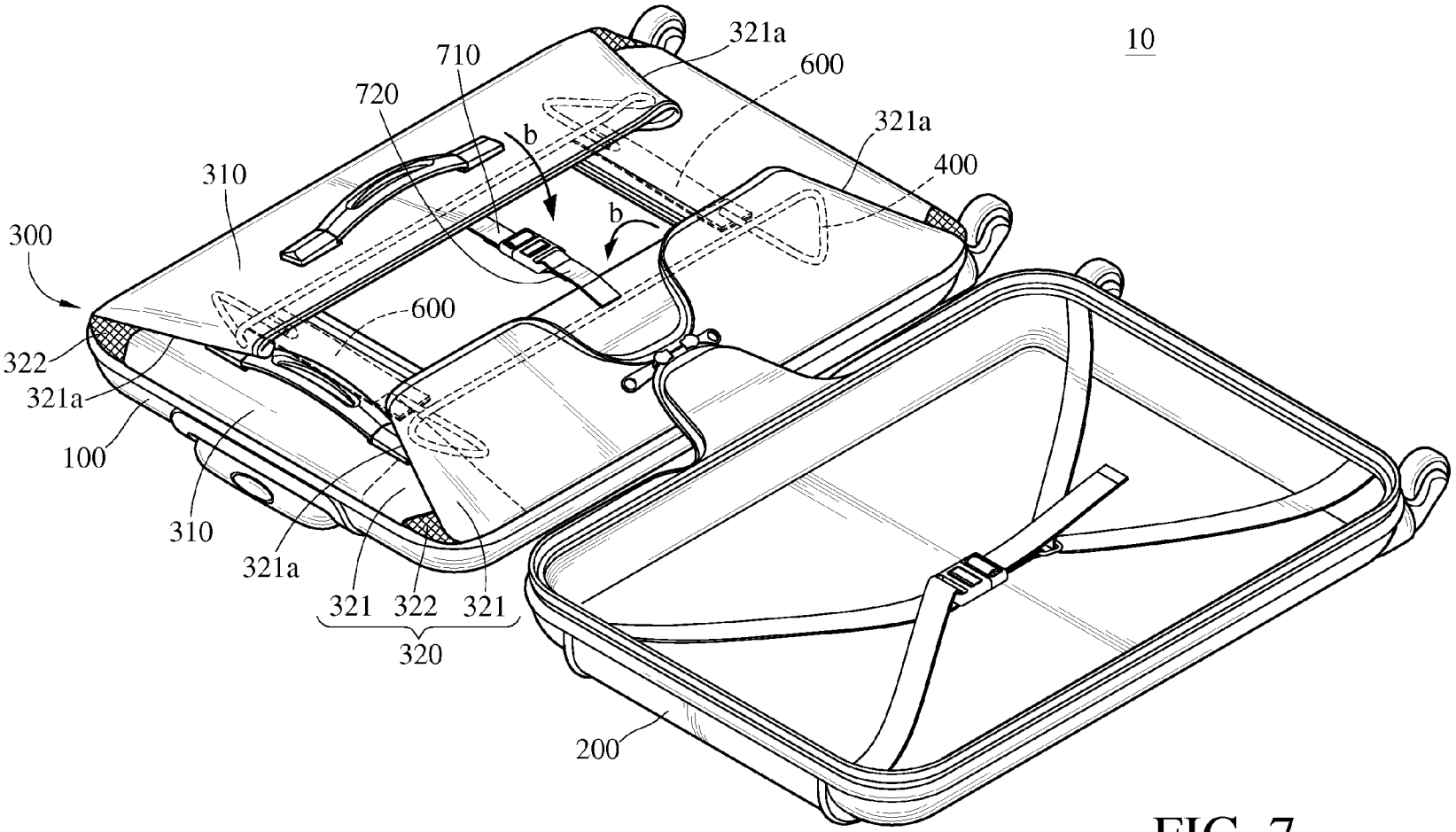
Figure 8:
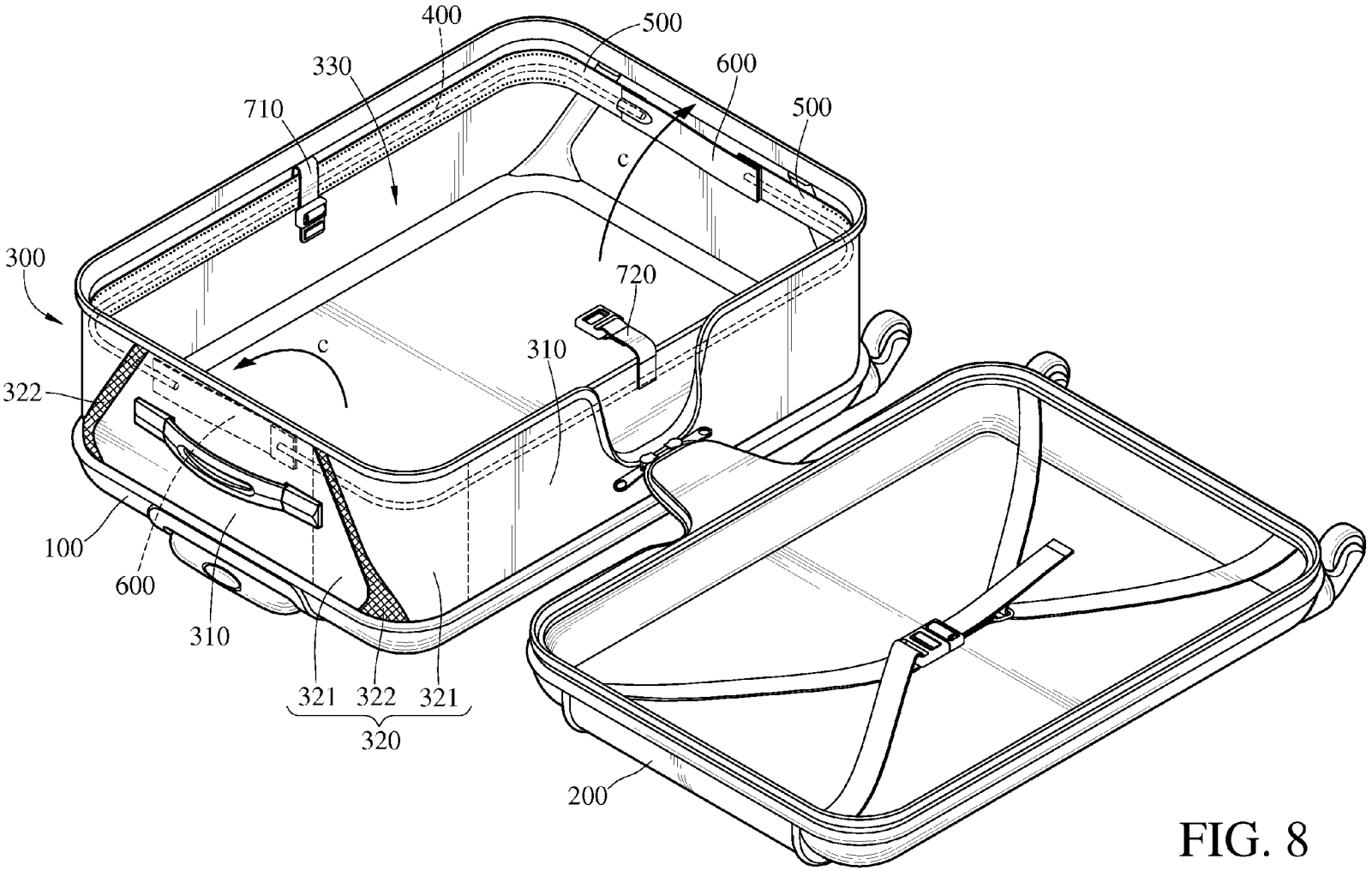
FIG. 8 is a perspective view of the restoration of the circumferential surface component in FIG. 2.

Please refer to FIGS. 6 to 8. FIG. 6 and FIG. 7 are schematic views of the circumferential surface component during a folding process in FIG. 2. FIG. 8 is a perspective view of the restoration of the circumferential surface component in FIG. 2. As shown in FIGS. 6 to 8, in this embodiment, the folding suitcase 10 further comprises a first belt 710 and a second belt 720. The first belt 710 and the second belt 720 are located on the two sidewall parts 310 opposite to each other, respectively.

As shown in FIG. 6, the upper and lower sidewall parts 310 may be pressed to be folded inward (along a direction indicated by an arrow a). Then, the left and right sidewall parts 310 are driven to bend inward relative to the back case component 100 by the upper and lower sidewall part 310. Accordingly, the fold lines 321*a* and 322*a* are formed on at least one of the link-up sections 321 and the bending section 322, respectively. When the link-up section 321 and the bending section 322 are bent, the elastic contortion section 420 of the restoring component 400 is driven to bend in the lateral direction. Accordingly, the elastic potential energy for restoration is stored by the elastic contortion section 420.

As shown in FIG. 7, the left sidewall part 310 and the right sidewall part 310 are totally folded on the back case component 100 (along a direction indicated by an arrow b). The first belt 710 and the second belt 720 are buckled with each other, to fix all the sidewall parts 310 in a folding state.

As shown in FIG. 8, when the first belt 710 and the second belt 720 are unbuckled by the user, the sidewall parts 310 are simultaneously driven to be erected by the elastic contortion section 420 of the restoring component 400 when the elastic potential energy is released.

Accordingly, when the user unbuckles the first belt 710 and the second belt 720, the sidewall parts 310 are simultaneously driven to be erected by the elastic contortion section 420 when the elastic potential energy is released. That is to say, the user does not need to restore the sidewall parts 310 manually. Thus, the usage of the folding suitcase 10 becomes more convenient.

Figure 9:
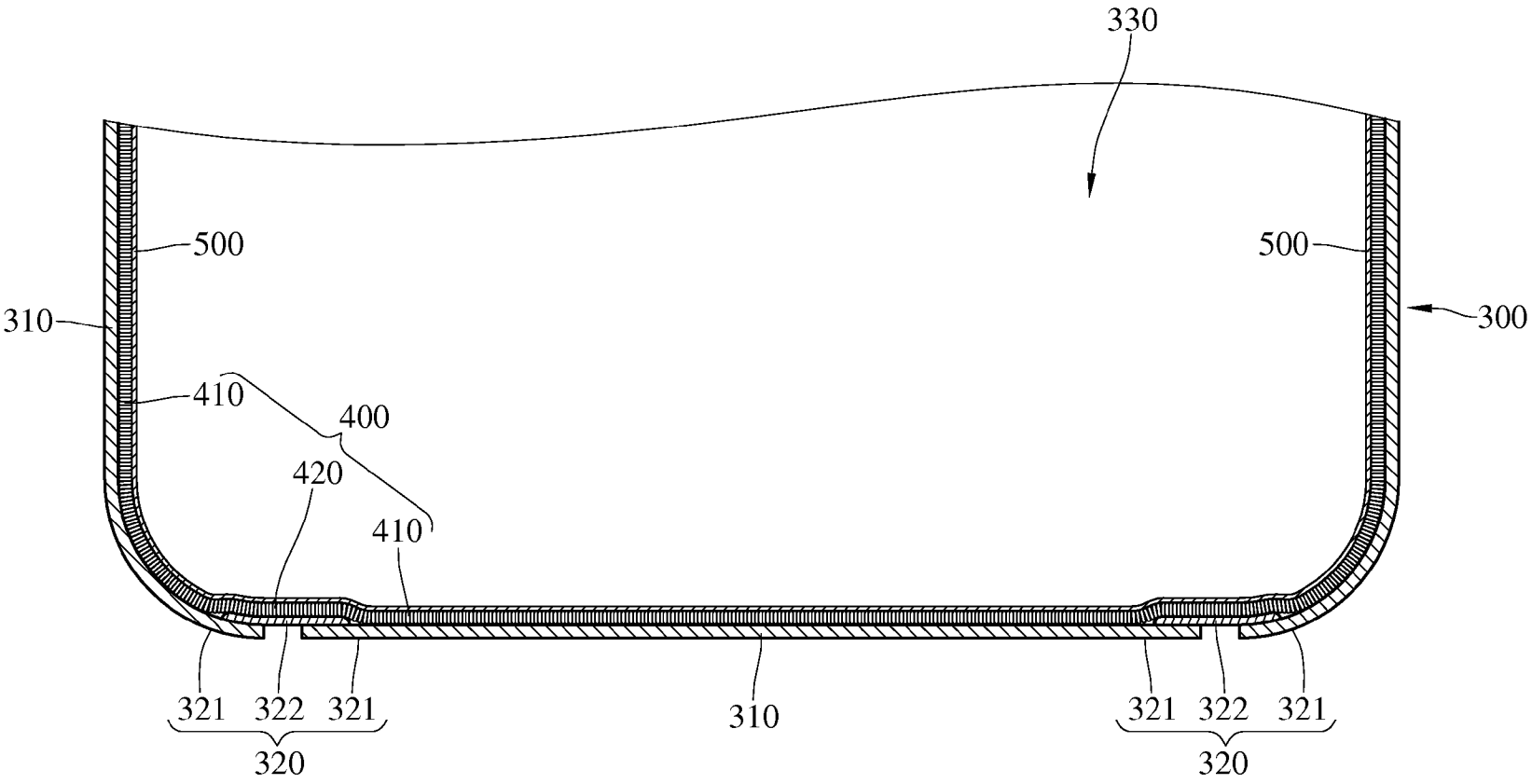
FIG. 9 is a sectional view of a circumferential surface component according to a second embodiment of the disclosure.

Please refer to FIG. 9, which is a sectional view of a circumferential surface component according to a second embodiment of the disclosure. This embodiment is similar to the embodiment shown in FIG. 3, so that only the difference between the first embodiment and the second embodiment will be described as follows.

The difference is that the bendable fixing component 500 is elastic, such as an elastic ribbon. In this embodiment, the restoring component 400 is located around the circumferential surface component 300 by one bendable fixing component 500. Accordingly, the restoring ability of the restoring component 400 may be enhanced.

Figure 10:
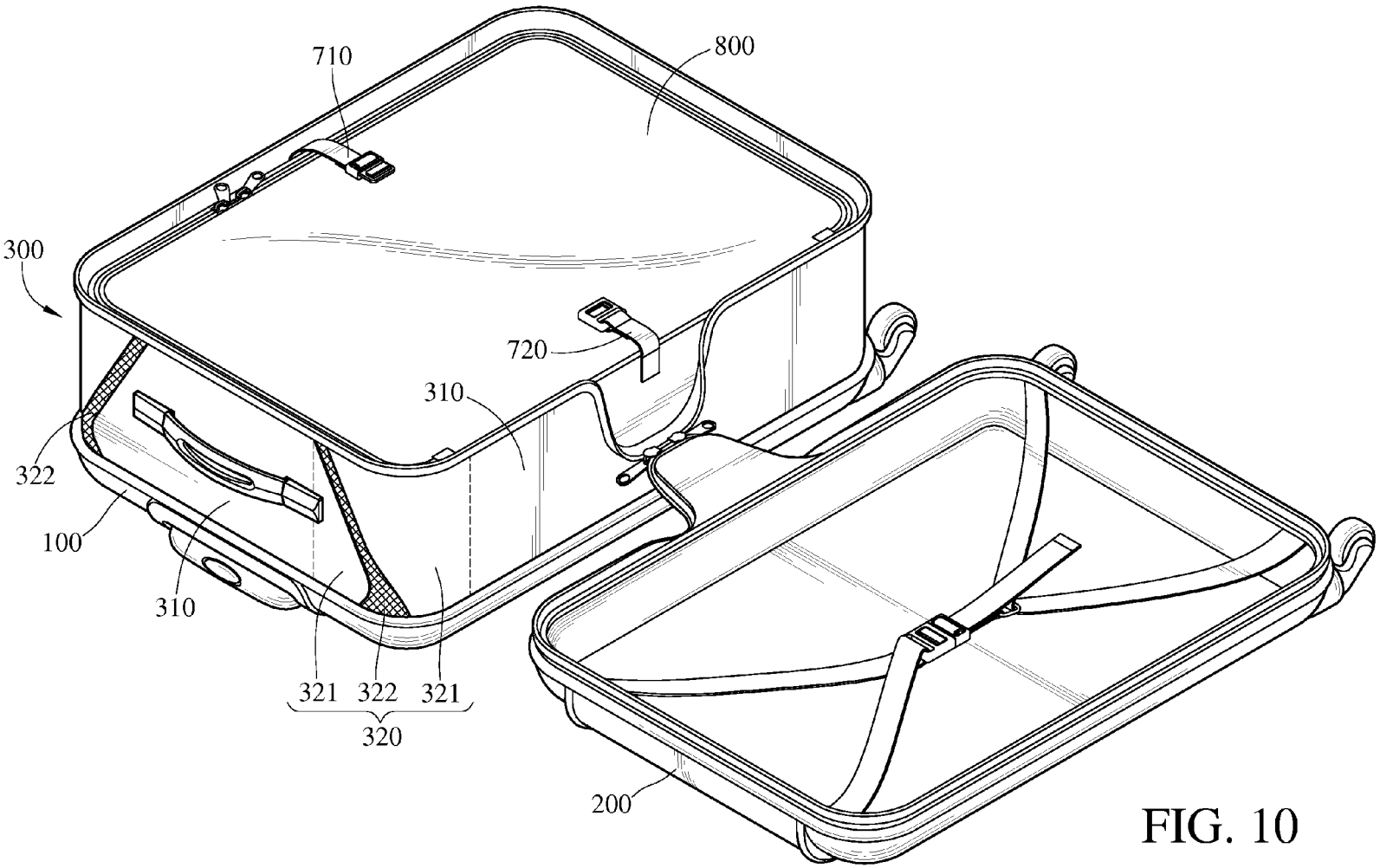
FIG. 10 is a sectional view of a circumferential surface component according to a third embodiment of the disclosure.

Please refer to FIG. 10, which is a sectional view of a circumferential surface component according to a third embodiment of the disclosure. This embodiment is similar to the embodiment shown in FIG. 3, so that only the difference between the first embodiment and the third embodiment will be described as follows.

The difference is that the folding suitcase 10 further comprises a flexible cover film 800. In this embodiment, the flexible cover film 800 and the circumferential surface component 300 can be joined together. Additionally, the circumferential surface component 300 can be closed by the zipper. When the accommodating space 330 is closed, fluids (such as air) in the accommodating space 330 may drive the sidewall parts 310 to be erected slowly.

To be noticed, the restoring component 400 is, but not limited to, adapted to the folding suitcase 10. In another embodiment, the restoring component 400 can be adapted to another folding suitcase (such as suitcase shown in Patent Application No. M471788 filled in Taiwan, R.O.C.) which may be erected automatically.

According to the embodiments of the folding suitcase, the sidewall parts are driven to be erected by the elastic contortion of the restoring component. Thus, the user does not need to restore the sidewall parts manually. The usage of the folding suitcase becomes more convenient.

Additionally, the two suspension sections connected to each other by the bendable fixing component is adapted to provide the spare space for contortions of the restoring component. Furthermore, the elastic force can be provided to the two suspension sections by an elastic component for restoring.

The disclosure will become more fully understood from the said embodiment for illustration only and thus does not limit the disclosure. Any modifications within the spirit and category of the disclosure fall in the scope of the disclosure.

What is claimed is:

1. A folding suitcase, comprising:

a back case component;

a front lid component;

a circumferential surface component, wherein two opposite sides of the circumferential surface component are connected with the back case component and the front lid component, respectively, to form an accommodating space; the circumferential surface component has a plurality of sidewall parts and a plurality of bending parts, two opposite sides of each of the plurality of bending parts being respectively connected to the adjacent sidewall parts, each of the plurality of bending parts being bendable so that the plurality of sidewall parts are foldable and erectable with respect to the back case component; and at least one restoring component being elastic and being disposed over the plurality of bending parts and on the plurality of sidewall parts such that the accommodating space is surrounded by the at least one restoring component for erecting the plurality of sidewall parts, wherein the at least one restoring component has two connection sections and an elastic contortion section, the two connection section are connected with two opposite sides of the elastic contortion section, respectively, the two connection sections are located on the two sidewall parts different from each other, respectively, the elastic contortion section is located on the bending part, and the at least one restoring component is located on the side of the circumferential surface component which is away from the back case component.

2. The folding suitcase according to claim 1, further comprising at least one bendable fixing component, wherein the restoring component is fixed on the circumferential surface component by the bendable fixing component.

3. The folding suitcase according to claim 2, wherein the material of the bendable fixing component is cloth, elastic ribbon or nylon.

4. The folding suitcase according to claim 2, further comprising an elastic component, the quantities of both the restoring component and the bendable fixing component are two, the two restoring components are fixed on the circumferential surface component by the two bendable fixing components, and the two restoring components correspond to the two bending parts different from each other, respectively, and the elastic component is connected with the two bendable fixing components.

5. The folding suitcase according to claim 4, wherein each bendable fixing component has a fixing section and a suspension section which are connected with each other, the two fixing sections are located on the circumferential surface component, and two ends of the elastic component are connected with the two suspension sections different from each other, respectively.

6. The folding suitcase according to claim 1, wherein the restoring component is a helical spring or an elastic strip.

7. The folding suitcase according to claim 1, wherein the shape of the restoring component is cylindrical shape.

8. The folding suitcase according to claim 1, wherein the plurality of sidewall parts are adapted to be bent relatively to the back case component, to make the plurality of bending parts form at least one fold line, and an extension line of the restoring component and the fold line are intersected with each other.

9. The folding suitcase according to claim 1, wherein the restoring component is adapted to store an elastic potential energy when the plurality of sidewall parts are not upright, and the plurality of sidewall parts are simultaneously driven to be erected by the restoring component when the elastic potential energy is released.

* * * * *